US005889468A

United States Patent [19]

Banga

[11] Patent Number: 5,889,468

[45] Date of Patent: Mar. 30, 1999

[54] EXTRA SECURITY SMOKE ALARM SYSTEM

[76] Inventor: William Robert Banga, 1910 Needle Palm Dr., Edgewater, Fla. 32141

[21] Appl. No.: 966,509

[22] Filed: Nov. 10, 1997

[51] Int. Cl.[6] ..... G08B 17/10

[52] U.S. Cl. ..... 340/628; 340/629; 340/691; 340/825.36; 379/40; 379/42; 379/43; 379/44; 379/45

[58] Field of Search ..... 340/628, 629, 340/691, 332, 506, 825.36, 825.37; 379/39, 40, 42, 43, 44, 45

[56] References Cited

U.S. PATENT DOCUMENTS

| | | | |
|---|---|---|---|
| 3,778,796 | 12/1973 | Honda | 340/629 |
| 3,806,921 | 4/1974 | Pappas | 340/429 |
| 4,074,225 | 2/1978 | Vandeweghe | 340/628 |
| 4,176,346 | 11/1979 | Johnson et al. | 340/524 |
| 4,417,235 | 11/1983 | Del Grande | 340/531 |
| 4,481,502 | 11/1984 | Dawson | 340/516 |
| 4,531,114 | 7/1985 | Topol et al. | 340/539 |
| 4,796,018 | 1/1989 | Nakanishi et al. | 340/691 |
| 5,159,315 | 10/1992 | Schultz et al. | 340/539 |
| 5,189,394 | 2/1993 | Walter et al. | 340/525 |
| 5,227,776 | 7/1993 | Starefoss | 340/825.36 |
| 5,461,365 | 10/1995 | Schlager et al. | 340/573 |
| 5,486,811 | 1/1996 | Wehrle et al. | 340/522 |
| 5,557,262 | 9/1996 | Tice | 340/587 |
| 5,568,535 | 10/1996 | Sheffer et al. | 379/39 |
| 5,587,705 | 12/1996 | Morris | 340/628 |
| 5,629,687 | 5/1997 | Sutton et al. | 340/825.37 |
| 5,710,803 | 1/1998 | Kowal et al. | 379/41 |
| 5,726,633 | 3/1998 | Wiemeyer | 340/587 |

*Primary Examiner*—Thomas J. Mullen Jr.
*Assistant Examiner*—Toan N Pham
*Attorney, Agent, or Firm*—Michael I. Kroll

[57] ABSTRACT

An extra security alarm system for monitoring conditions within a predetermined monitoring area and alerting persons located throughout the monitoring area, persons in the vicinity and appropriate emergency personnel of an emergency situation. The extra security alarm system includes a plurality of sensors strategically positioned throughout the monitoring area for sensing conditions within the monitoring area. Each of the sensors includes a control unit for analyzing the sensed conditions to determine if an alarm situation exists and generating a sensor signal indicative of the sensed conditions, a transmitter for transmitting the generated signal to the other sensors, a receiver for receiving sensor signals from the other sensors and an alarm for generating an alarm signal upon determining an alarm condition has been sensed by the system. A central monitoring unit is centrally positioned within the monitoring area and includes a receiver for receiving sensor signals from the sensors, a control unit for analyzing the received signals and generating an emergency signal upon determining an emergency situation exists and a transmitter for transmitting the generated emergency signal. A telephone unit for alerting emergency personnel is positioned to receive the emergency signal from the central monitoring unit and a device for alerting persons in a vicinity of the monitoring area upon receipt of said emergency signal from said central monitoring unit is positioned about a periphery of the monitoring area.

15 Claims, 12 Drawing Sheets

EXTRA SECURITY SMOKE ALARM SYSTEM

BACKGROUND OF THE INVENTION

1. Field of the Invention

The present invention relates generally to smoke and security systems and, more specifically, to a system for monitoring a designated area for smoke, intruders and other conditions and alerting the proper authorities and persons within both the designated area and surrounding vicinity as to an emergency situation.

2. Description of the Prior Art

Numerous security systems for monitoring the conditions of an area such as within a house have been provided in the prior art. These security systems include burglar alarms, smoke alarms, motion detectors, timer devices for turning on lights and many others. However, these units are unable to perform all of the many functions needed for adequately securing an entire area from all possible dangers. These systems are further not able to alert persons in other sections of the monitored area, in the vicinity of the secured area and the appropriate authorities and emergency personnel as to a sensed emergency situation. Furthermore, these systems do not include a plurality of individual monitoring units which communicate with both each other and a central monitoring unit to fully monitor the entire monitoring area. While these systems may be suitable for the particular purpose to which they address, they would not be as suitable for the purposes of the present invention as heretofore described.

It is thus desirable to provide a security monitoring system which is able to adequately monitor an entire area and alert persons within all sections of the monitored area as to the existence of an emergency situation in another section of the monitored area. It is further desirable to produce a system which will monitor a plurality of different emergency situations and alert the proper emergency personnel as to the situation.

SUMMARY OF THE PRESENT INVENTION

The present invention relates generally to smoke and security systems and, more specifically, to a system for monitoring a designated area for smoke, intruders and other situations and alerting the proper authorities and persons within both the designated area and surrounding vicinity as to an emergency situation.

A primary object of the present invention is to provide a smoke and intruder monitoring security system that will overcome the shortcomings of prior art devices.

Another object of the present invention is to provide a smoke and intruder monitoring security system which is able to monitor a large area and alert persons in the vicinity of the area and the proper emergency personnel upon sensing an emergency situation.

An additional object of the present invention is to provide a smoke and intruder monitoring security system including a telephone unit for phoning the proper emergency personnel and paging the residents of the monitored area alerting them to the existence of an emergency situation.

A further object of the present invention is to provide a smoke and intruder monitoring security system which is able to produce a visible alarm both within and outside a structure being monitored upon sensing of an emergency situation.

A yet further object of the present invention is to provide a smoke and intruder monitoring security system including a plurality of sensors for monitoring a plurality of conditions in communication with both each other and a central monitoring unit.

A still further object of the present invention is to provide smoke and intruder monitoring security system including a plurality of individual sensors in communication with each other.

A still further object of the present invention is to provide a smoke and intruder monitoring security system including a plurality of individual sensor units, each unit being able to transmit signals over a plurality of different frequencies.

Another object of the present invention is to provide a smoke and intruder monitoring security system that is simple and easy to use.

A still further object of the present invention is to provide a smoke and intruder monitoring security system that is economical in cost to manufacture.

Additional objects of the present invention will appear as the description proceeds.

An extra security alarm system for monitoring conditions within a predetermined monitoring area and alerting persons located throughout the monitoring area, persons in the vicinity and appropriate emergency personnel of an emergency situation is disclosed by the present invention. The extra security alarm system includes a plurality of sensors strategically positioned throughout the monitoring area for sensing conditions within the monitoring area. Each of the sensors includes a control unit for analyzing the sensed conditions to determine if an alarm situation exists and generating a sensor signal indicative of the sensed conditions, a transmitter for transmitting the generated signal to the other sensors, a receiver for receiving sensor signals from the other sensors and an alarm for generating an alarm signal upon determining an alarm condition has been sensed by the system. A central monitoring unit is centrally positioned within the monitoring area and includes a receiver for receiving sensor signals from the sensors, a control unit for analyzing the received signals and generating an emergency signal upon determining an emergency situation exists and a transmitter for transmitting the generated emergency signal. A telephone unit for alerting emergency personnel is positioned to receive the emergency signal from the central monitoring unit and a device for alerting persons in a vicinity of the monitoring area upon receipt of said emergency signal from said central monitoring unit is positioned about a periphery of the monitoring area.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
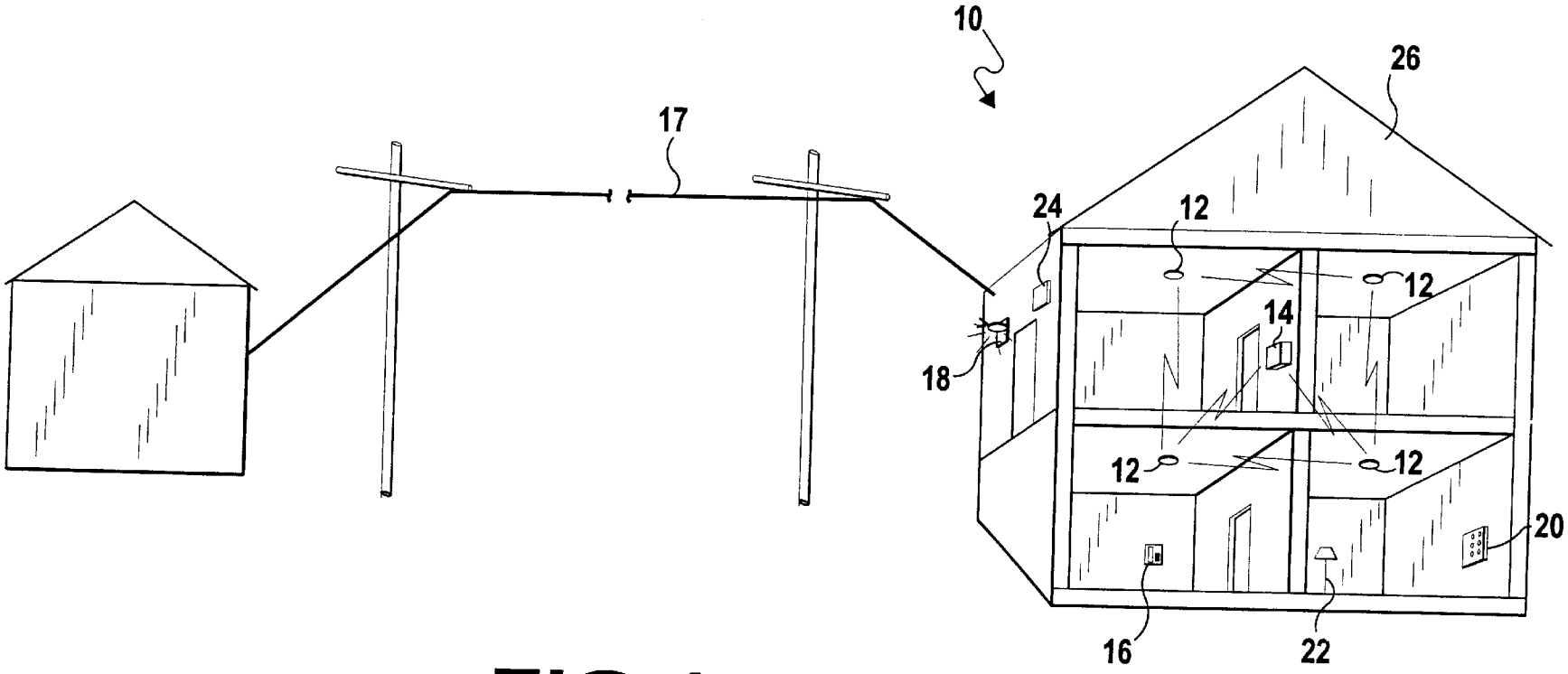
FIG. 1 is a perspective view of the extra security smoke alarm system of the present invention installed within a house.

Turning now descriptively to the drawings, in which similar reference characters denote similar elements throughout the several views, the figures illustrate an extra security smoke alarm system of the present invention. With regard to the reference numerals used, the following numbering is used throughout the various drawing figures.

10 extra security smoke alarm system of the present invention
12 alarm detector
14 central monitor unit
16 telephone unit
17 telephone line
18 location flasher unit
20 plug 'n power flasher
22 lamp flasher
24 outdoor alarm unit
26 monitored area/house in which extra security smoke alarm system is installed
28 receiver antenna for alarm detector unit
30 receiver for alarm detector unit
32 receiver tuner for alarm detector unit
34 power source for alarm detector unit
36 transmitter antenna for alarm detector unit
38 transmitter for alarm detector unit
40 transmitter tuner for alarm detector unit
42 control unit for alarm detector unit
44 audible alarm for alarm detector unit
46 sensor for alarm detector unit
48 manual switch for alarm detector unit
50 alarm reset button for alarm detector unit
52 receiver antenna for alarm monitor unit
54 receiver for alarm monitor unit
56 receiver tuner for alarm monitor unit
58 power source for alarm monitor unit
60 controller for alarm monitor unit
62 transmitter antenna for alarm monitor unit
64 transmitter for alarm monitor unit
66 transmitter tuner for alarm monitor unit
68 audible alarm for alarm monitor unit
70 reset button for alarm monitor unit
72 LED's for alarm monitor unit
74 receiver antenna for telephone unit
76 receiver for telephone unit
78 receiver tuner for telephone unit
80 power source for telephone unit
82 controller for telephone unit
84 telephone base unit for telephone unit
86 telephone connector for telephone unit
87 cellular communication transmitter
88 telephone keypad for telephone unit
89 wired or cellular switch
90 speaker for telephone unit
92 microphone for telephone unit
94 learn/run switch
96 display for telephone unit
98 memory for telephone unit
100 operating mode switch for telephone unit
101 reset switch for telephone unit
102 receiver antenna for location flasher unit
104 receiver for location flasher unit
106 receiver tuner for location flasher unit
108 power source for location flasher unit
110 controller for location flasher unit
112 flasher for location flasher unit
114 audible alarm for location flasher unit
116 receiver antenna for plug 'n power flasher unit
118 receiver for plug 'n power flasher unit
120 receiver tuner for plug 'n power flasher unit
122 power source for plug 'n power flasher unit
124 controller for plug 'n power flasher unit
125 electrical outlets for connection with lamp flasher units
126 alarm for plug 'n power flasher unit
128 alarm reset button for plug 'n power flasher unit
130 receiver antenna for lamp flasher unit
132 receiver for lamp flasher unit
134 receiver tuner for lamp flasher unit
136 power source for lamp flasher unit
138 controller for lamp flasher
139 audible alarm
140 lamp for lamp flasher
142 receiver antenna for outdoor alarm unit
144 receiver for outdoor alarm unit
145 receiver tuner
146 receiver tuner for outdoor alarm unit

148 power source for outdoor alarm unit
150 controller for outdoor alarm unit
152 audible alarm for outdoor alarm unit
154 monitor console unit
156 face of monitor console unit
158 LED's for monitor console unit
160 power cord for monitor console unit
162 reset button for monitor console unit
164 temperature sensor unit
166 control unit
168 power source
170 transmitter antenna
172 transmitter
174 transmitter tuner
176 temperature sensor
178 audible alarm
180 alarm reset
182 display
184 manual on/off switch
186 water level sensor unit
188 control unit
190 power source
192 transmitter antenna
194 transmitter
196 transmitter tuner
198 water level sensor
200 audible alarm
202 alarm reset
204 manual on/off switch

DETAILED DESCRIPTION OF THE PREFERRED EMBODIMENT

Turning now descriptively to the drawings, in which similar reference characters denote similar elements throughout the several views, FIGS. 1 through 12 illustrate an extra security smoke alarm system indicated generally by the numeral 10.

The extra security smoke alarm system 10 is illustrated in FIG. 1 installed within a monitoring area 26. The extra security smoke alarm system 10 is designed to fully monitor a plurality of conditions within the monitoring area 26 and includes a plurality of alarm detectors 12 positioned through out the monitoring area 26. In the presently described example the monitoring area is a house. However, in practice the monitoring area 26 may include any type of structure such as an office building, commercial building, factory, barn, etc. and monitor any desired area such as a building complex, a farm, a residential complex, etc. with the only limitation being the strength of the detectors 12 and their effective transmission range. The detectors 12 are able to monitor conditions including but not limited to smoke, carbon monoxide, propane gas, motion, light, temperature, water level, etc. Each alarm detector 12 is in wireless communication with each other as well as with a centrally located central monitor unit 14.

Also positioned within the monitoring area 14 and in wireless communication with the central monitor unit 14 is a telephone unit 16. The telephone unit 16 is connected to the telephone line 17 for communicating the existence of an emergency situation to the proper emergency personnel as well as the residents of the monitored area 26. A location flasher unit 18 is positioned at an outer periphery of the monitored area 26 for visually alerting persons in the vicinity of the monitored area as to the existence of an emergency situation upon receipt of an emergency signal from the central monitor unit 14. A plug 'n power flasher alarm 20 is in wireless communication with the central monitor unit 14 and a plurality of lamp flashers 22 are connect ed to the plug 'n power flasher 20. Upon receiving an emergency signal from the central monitor unit 14 the plug 'n power flasher 20 generates an audible alarm and activates the lamp flashers 22 to flash on and off providing a visual alarm for hearing impaired persons within the monitoring area 26. An outdoor alarm 24 is also in wireless communication with the central monitoring unit 14 for audibly alerting persons in the vicinity of the monitored area 26 as to an emergency situation.

Figure 2:
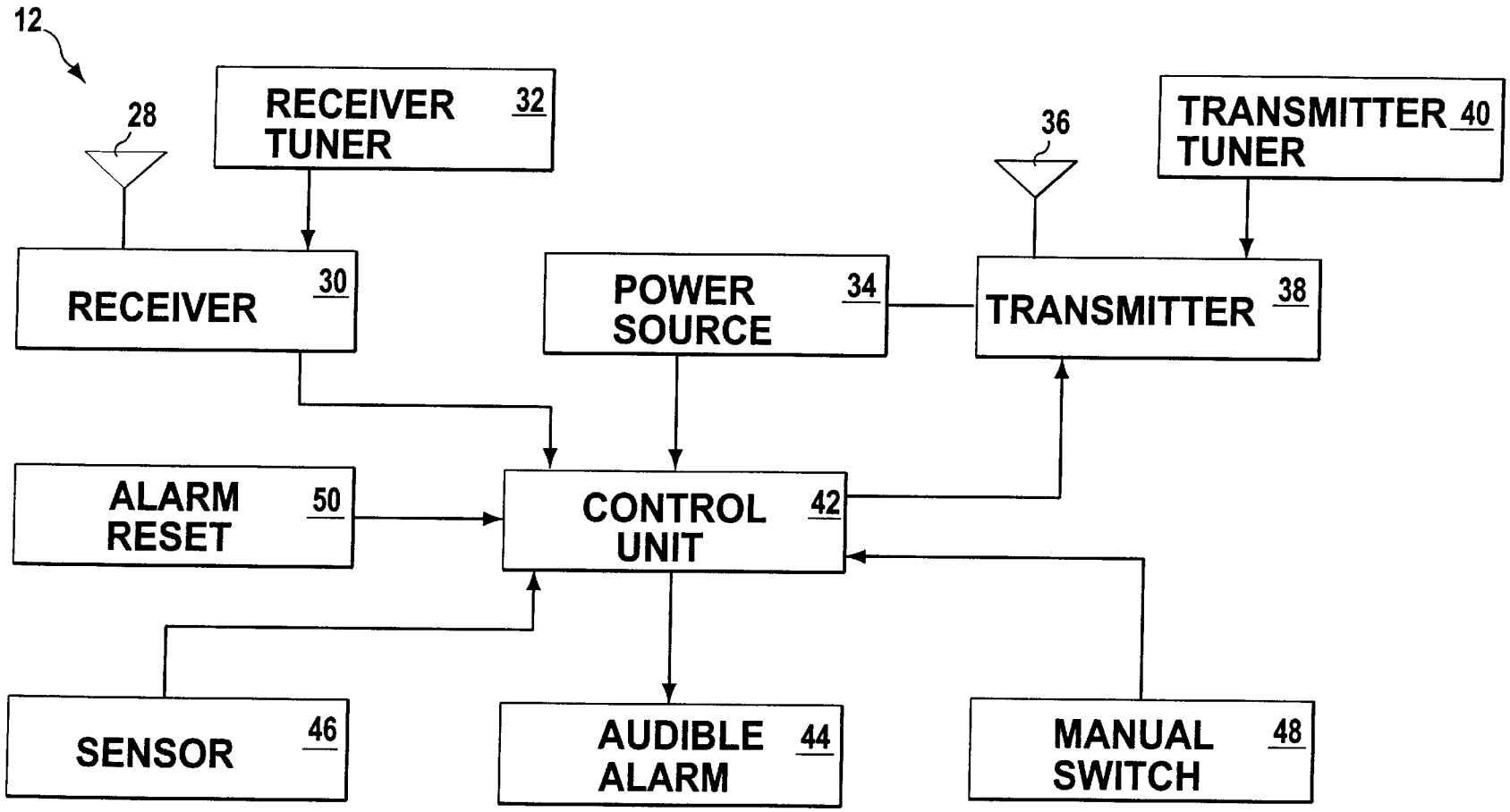
FIG. 2 is a schematic diagram of an alarm detector for use with the extra security smoke alarm system of the present invention.

A schematic drawing of an alarm detector 12 is shown by FIG. 2. Each alarm detector 12 is strategically positioned about the monitoring area 26 and includes a receiver antenna 28 connected to a receiver 30 for receiving signals from both the central monitoring unit 14 and other alarm detectors 12 dispersed throughout the monitoring area 26. A receiver tuning apparatus 32 is connected to the receiver 30 for tuning the receiving frequency of the receiver 30 to match the transmission frequency of the signals transmitted by the central monitoring unit 14 and the other alarm detectors 12. A transmitting antenna 36 is connected to a transmitter 38 also contained within the alarm detector 12 for transmitting sensor signals indicative of conditions sensed by the alarm detector 12 to the central monitoring unit 14 and the other alarm detectors 12. A transmitter tuning apparatus 40 is connected to the transmitter 38 for tuning the transmitting frequency of the transmitter 38 to match the receiving frequency of the central monitoring unit 14 and the other alarm detectors 12. Each alarm detector 12 is able to transmit and receive signals at a plurality of different frequencies. This reduces interference in the transmitted signals and prevents cross-talk with other systems monitoring nearby areas.

A control unit 42 is connected to receive power from a power supply 34 and to the receiver 30 for analyzing the received signals to determine if an emergency situation has been sensed by one of the other alarm detectors 12 or the central monitoring unit 14 has been reset The power supply 34 may be an internal supply such as a battery or may be an external source such as a conventional electrical outlet. The control unit 42 is also connected to the transmitter 38 for sending the generated sensor signals to be transmitted by the transmitter 38 to the other alarm detectors 12 and the central monitoring unit 14. A sensor 46 is also connected to the control unit 42 for sensing conditions in the area surrounding the alarm monitor 12 and generating a signal indicating the sensed conditions to the control unit 42 for analysis. The sensor 46 is able to monitor conditions including but not limited to smoke, carbon monoxide, propane gas, motion, light, temperature, etc. An audible alarm 44 such as an amplifier and speaker combination is connected to the control unit 42 for generating an audible alarm signal upon a determination by the control unit 42 that an emergency situation has been sensed by the alarm monitor and/or one of the other alarm monitors. Also connected to the control unit 42 is a manual switch 48 for turning the alarm monitor 12 on, off or to manually trigger the alarm monitor 12 and an alarm reset button 50 for resetting the alarm monitor 12 after the alarm has been triggered.

Figure 3:
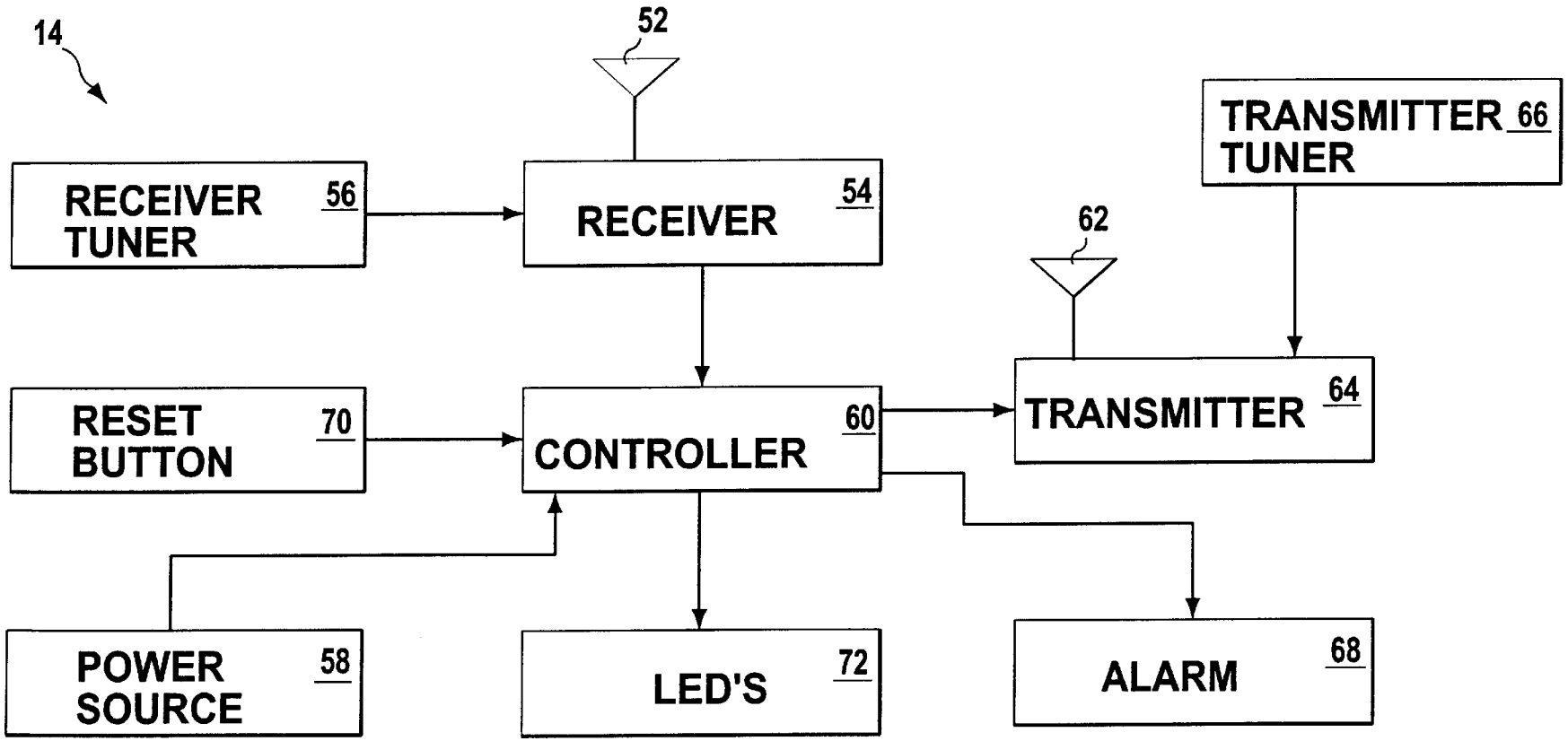
FIG. 3 is a schematic diagram of a monitor for use with the extra security smoke alarm system of the present invention.

FIG. 3 is a schematic drawing of the central monitoring unit 14. The central monitoring unit 14 is centrally located within the monitoring area 26 so it may be readily viewed and includes a receiver antenna 52 connected to a receiver 54 for receiving signals from the plurality of alarm detectors 12 dispersed throughout the monitoring area 26. A receiver tuning apparatus 56 is connected to the receiver 54 for tuning the receiving frequency of the receiver 54 to match the transmission frequency of the signals transmitted by the plurality of alarm detectors 12. The central monitoring unit 14 is also able to scan a range of frequencies and thereby receive signals transmitted at a plurality of different frequencies. A transmitting antenna 62 is connected to a transmitter 64 also contained within the central monitoring unit 14 for transmitting a reset signal to the plurality of alarm detectors 12 upon resetting the system at the central monitoring unit 14. A transmitter tuning apparatus 66 is connected to the transmitter 64 for tuning the transmitting frequency of the transmitter 64 to match the receiving frequency of the plurality of alarm detectors 12 as well as the other monitoring and alarm components within the monitoring area 26. The central monitoring unit 14 is able to transmit and receive signals at a plurality of different frequencies. This reduces interference in the transmitted signals and prevents cross talk with other systems monitoring nearby areas.

A controller 60 is located within the central monitoring unit 14. It is connected to receive power from a power supply 58 and to the receiver 54 for analyzing the received signals to determine if an emergency situation has been sensed by one of the plurality of alarm detectors 12. The power supply 58 may be an internal supply such as a battery or may be an external source such as a conventional electrical outlet. The controller 60 is also connected to the transmitter 64 for sending signals to be transmitted by the transmitter 64 to the plurality of alarm detectors 12 and other components of the system 10 within the monitoring area 26. An audible alarm 68 such as an amplifier and speaker combination is connected to the controller 60 for generating an audible alarm upon a determining by the controller 60 that an emergency situation has been sensed by at least one of the plurality of alarm monitors 12. Also connected to the controller 60 is an alarm reset button 70 for resetting the alarm monitor 12 after the alarm has been triggered and an LED display 72 for indicating which of the plurality of alarm monitors 12 has sensed an emergency situation.

Figure 4:
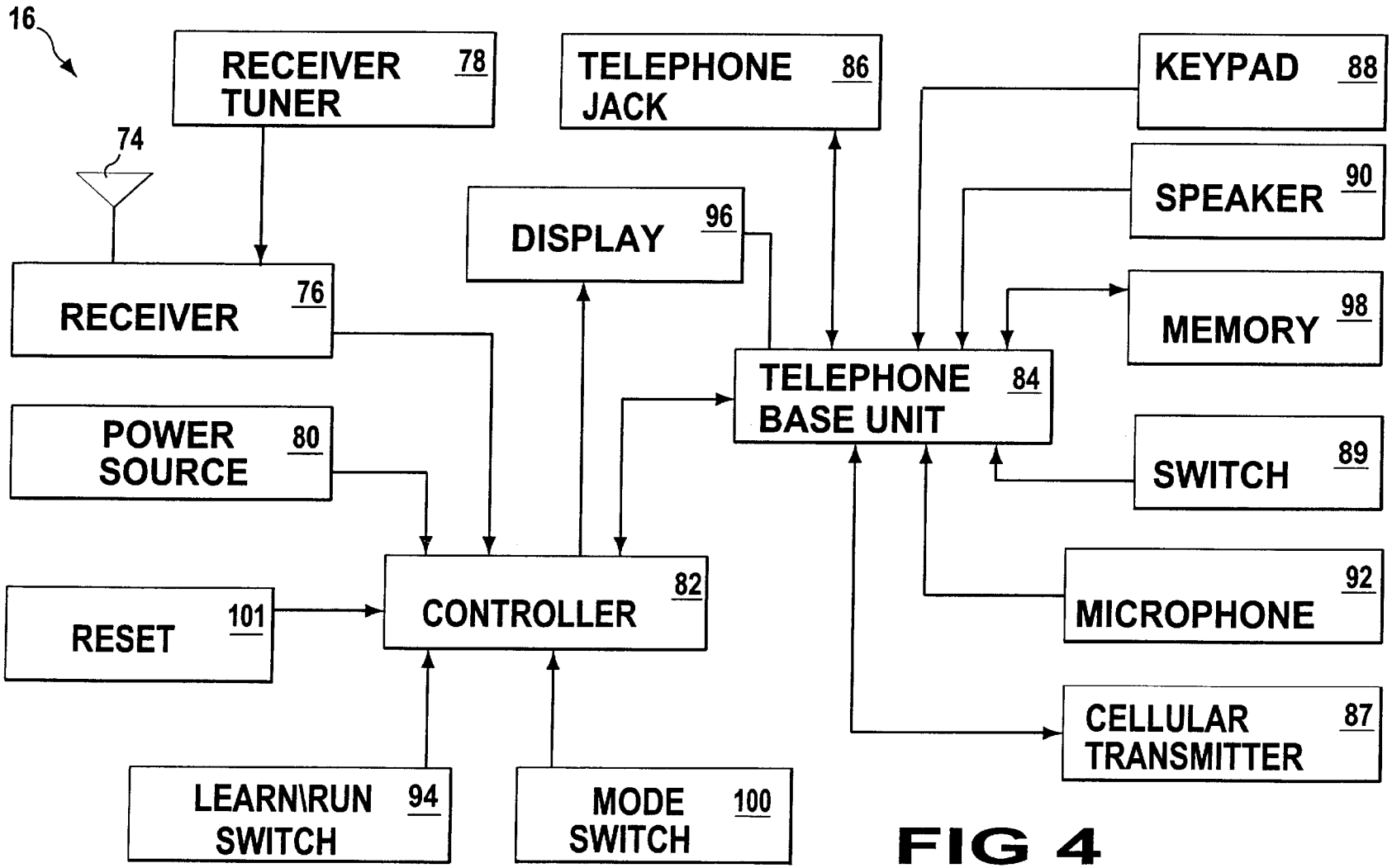
FIG. 4 is a schematic diagram of a phone unit for use with the extra security smoke alarm system of the present invention.

FIG. 4 is a schematic drawing of the telephone unit 16. The telephone unit 16 is located adjacent a telephone jack for connection thereto so it can alert the proper emergency personnel and the residents of the monitoring area telephonically upon the sensing of an emergency situation by any of the plurality of alarm monitors 12. The telephone unit 16 includes a receiver antenna 74 and receiver 76 for receiving signals indicative of an alarm situation from the central monitoring unit 14. A receiver tuning apparatus 78 is connected to the receiver 76 for tuning the receiving frequency of the receiver 76 to match the transmission frequency of the signals transmitted by the central monitoring unit 14. A telephone base unit 84 is connected to a telephone connector 86 for connection to the telephone line 17 and to a cellular telephone transmitter 87 for utilizing cellular communication methods to contact the proper emergency personnel and residents of the monitored area. The telephone numbers for emergency personnel and the residents of the monitored area are stored in a memory 98 accessed by the telephone base unit 84 upon receipt of a signal indicative of an emergency situation. A keypad 88 is connected to the telephone base unit 84 for manually placing a telephone call and a switch 89 is connected to the telephone base unit 84 for selecting between wired and cellular communication. The switch 89 may be manually controlled to select between wired or cellular communication. Alternatively, the switch 89 may automatically select between wired or cellular communication. If the switch 89 operates automatically it will include a sensor for detecting when the telephone unit 16 is connected to a wired telephone line 17. This is accomplished by monitoring the current present at the telephone jack 86 and will switch the telephone unit 16 to a wired communication mode when a current is sensed. At all other times the switch 89 will be positioned in a cellular communication mode connecting the cellular transmitter 87 to the telephone base unit 84. A speaker 90 and microphone 92 are also connected to the telephone base unit 84 providing an hands free speakerphone feature for the telephone unit 16.

A controller 82 is connected to receive power from a power supply 80, to the receiver 76 for analyzing the received signals and to the telephone base unit 84 for initiating an automatic dialing of emergency numbers stored in the memory 98 upon determining a signal indicating an emergency situation has been received. The power supply 58 may be an internal supply such as a battery or may be an external source such as a conventional electrical outlet. Also connected to the controller 82 is a mode switch 100 for switching the telephone unit 16 between a home, away and local mode. The home mode indicates the residents are present in the monitoring area and the away mode indicates the absence of persons within the monitored area 26. The local mode activates the pager feature of the telephone unit 16 and the residents of the monitored area 26 will then be paged in the event an emergency is sensed. An alarm reset button 101 for resetting the telephone unit 16 upon a receipt of a false emergency signal or upon resolution of the emergency situation.

Figure 5:
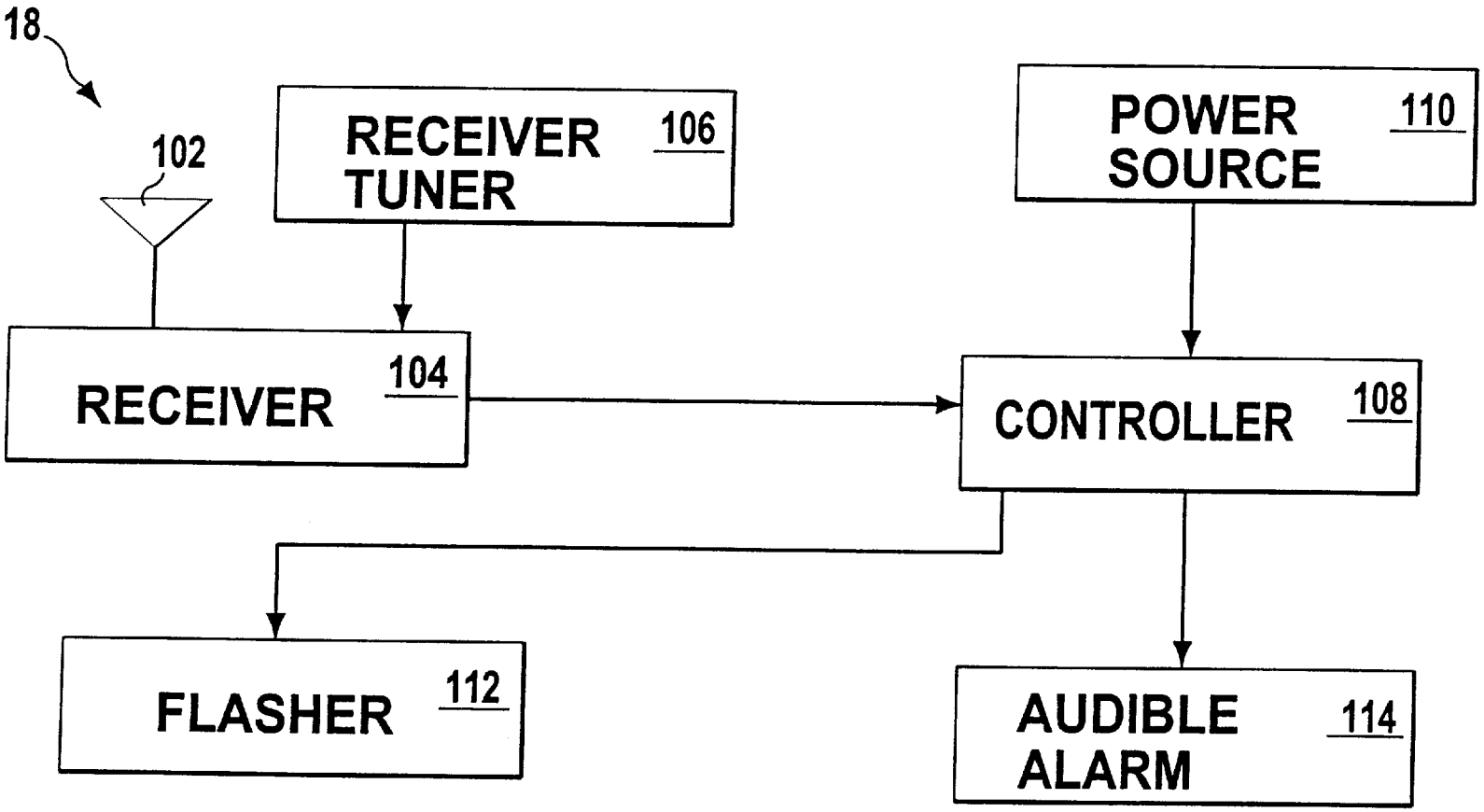
FIG. 5 is a schematic diagram of a location flashing alarm for use with the extra security smoke alarm system of the present invention.

A schematic drawing of the location flasher unit 18 is shown in FIG. 5. The location flasher unit 18 is located at an outer periphery of the monitored area 26 for alerting persons in the vicinity of the monitored area 26 as to an emergency situation upon receipt of a signal from the central monitoring unit 14. The location flasher unit 16 includes a receiver antenna- 102 connected to a receiver 104 for receiving signals indicative of an alarm situation from the central monitoring unit 14. A receiver tuning apparatus 106 is connected to the receiver 104 for tuning the receiving frequency of the receiver 104 to match the transmission frequency of the signals transmitted by the central monitoring unit 14.

A controller 108 is located within the location flasher unit 18 and is connected to both a power supply 110 receiving power therefrom and to the receiver 104 for analyzing the signals received from the central monitoring unit 14 to determine if a signal indicating an emergency situation has been received. The power supply 110 may be an internal supply such as a battery or may be an external source such as a conventional electrical outlet. Also connected to the controller 108 is a flasher 112 for producing a flashing light effect and visual indication that an emergency situation exists and an audible alarm 114 for producing an audible indication that an emergency situation exists.

Figure 6:
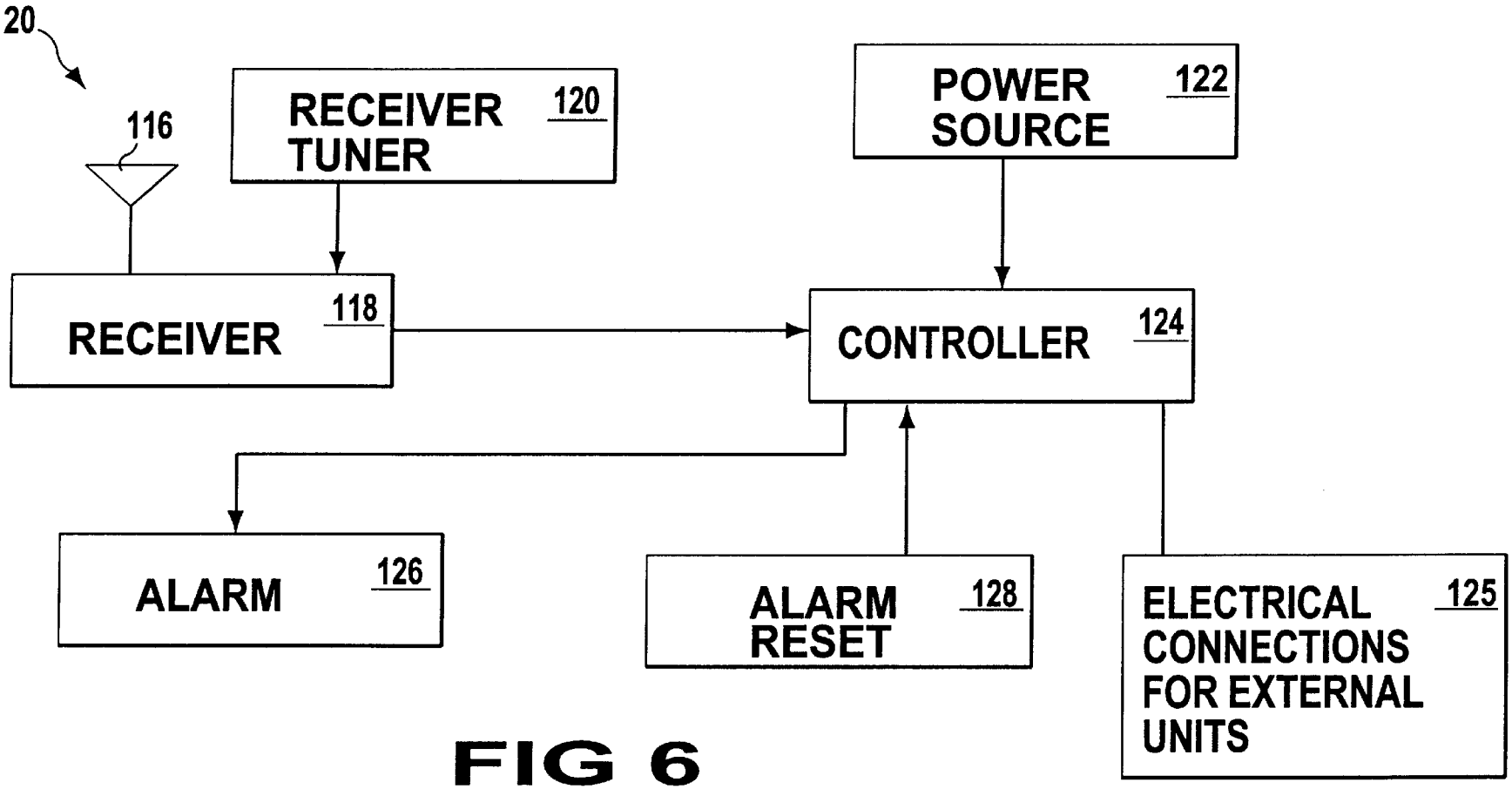
FIG. 6 is a schematic diagram of a plug 'n power flasher for use with the extra security smoke alarm system of the present invention.

FIG. 6 is a schematic drawing of the plug 'n power flasher 20. The plug 'n power flasher 20 is located within the monitored area 26 for controlling a plurality of fixtures such as lamps to provide a visual indication that an emergency situation exists. This is mainly for the benefit of hearing impaired persons present within the monitored area 26. The plug 'n power flasher 20 includes a receiver antenna 116 connected to a receiver 118 for receiving signals indicative of an alarm situation from the central monitoring unit 14. A receiver tuning apparatus 120 is connected to the receiver 118 for tuning the receiving frequency of the receiver 118 to match the transmission frequency of the signals transmitted by the central monitoring unit 14.

A controller 124 is connected to receive power from a power supply 122 and to the receiver 118 for analyzing the signals received from the central monitoring unit 14 to determine if a signal indicating an emergency situation has been received. The power supply 122 may be an internal supply such as a battery or may be an external source such as a conventional electrical outlet. Also connected to the controller 124 is an audible alarm for producing an audible indication that an emergency situation exists and a reset switch 128 for resetting the plug 'n power flasher 20 upon a receipt of a false emergency signal or resolution of the emergency situation. Also connected to the controller 124 are a plurality of electrical outlets 125 for connection to and control of a plurality of fixtures 22 within the immediate area of the plug 'n power flasher 20. The plug 'n power flasher 20 will cause light fixtures 22 connected to the electrical connections 125 to produce a flashing light effect and visual indication that an emergency situation exists.

Figure 7:
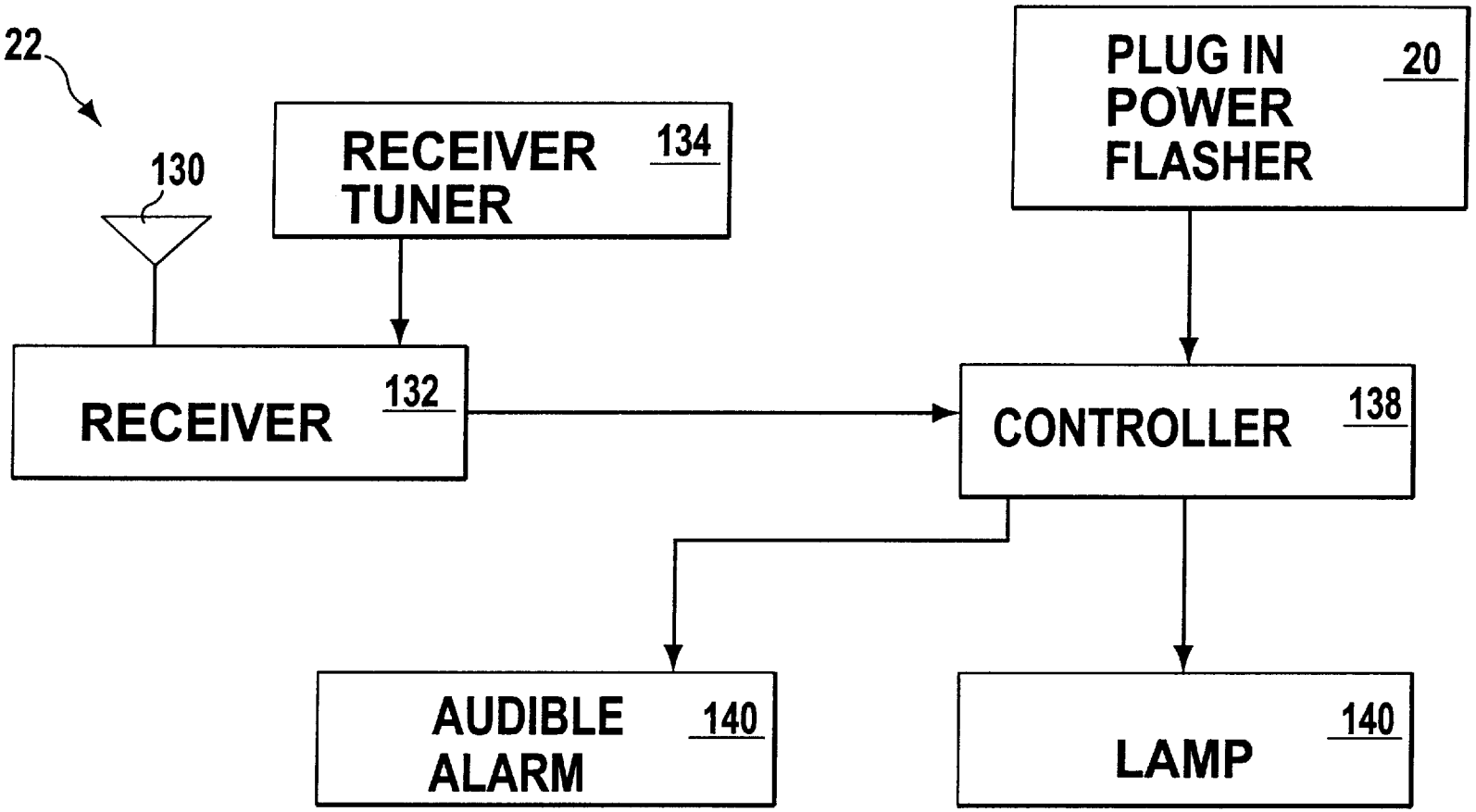
FIG. 7 is a schematic diagram of a lamp flasher for use in the extra security smoke alarm system of the present invention.

A schematic drawing of the lamp flasher 22 is shown in FIG. 7. The lamp flasher 22 is controlled by the plug 'n power flasher 20 for providing a visual indication that an emergency situation exists. This is mainly for the benefit of hearing impaired persons present within the monitored area 26. The lamp flasher 22 may be connected to the plug 'n power flasher 20 either through a hardwired or wireless connection and includes a receiver antenna 130 connected to a receiver 132 for receiving signals indicative of an alarm situation from the plug 'n power flasher 20. A receiver tuning apparatus 134 is connected to the receiver 132 for tuning the receiving frequency of the receiver 118 to match the transmission frequency of signals transmitted by the plug 'n power flasher 20.

A controller 138 is either connected directly to receive power from the plug 'n power flasher 20 or to a separate power supply 136 and to the receiver 132 for analyzing the signals received from the plug 'n power flasher 20 to determine if a signal indicating an emergency situation has been received. Also connected to the controller 124 is an audible alarm 139 for producing an audible indication that an emergency situation exists and a lamp 140 for both lighting the surrounding area and producing a flashing light effect and visual indication that an emergency situation exists under the control of the plug 'n power flasher 20.

Figure 8:
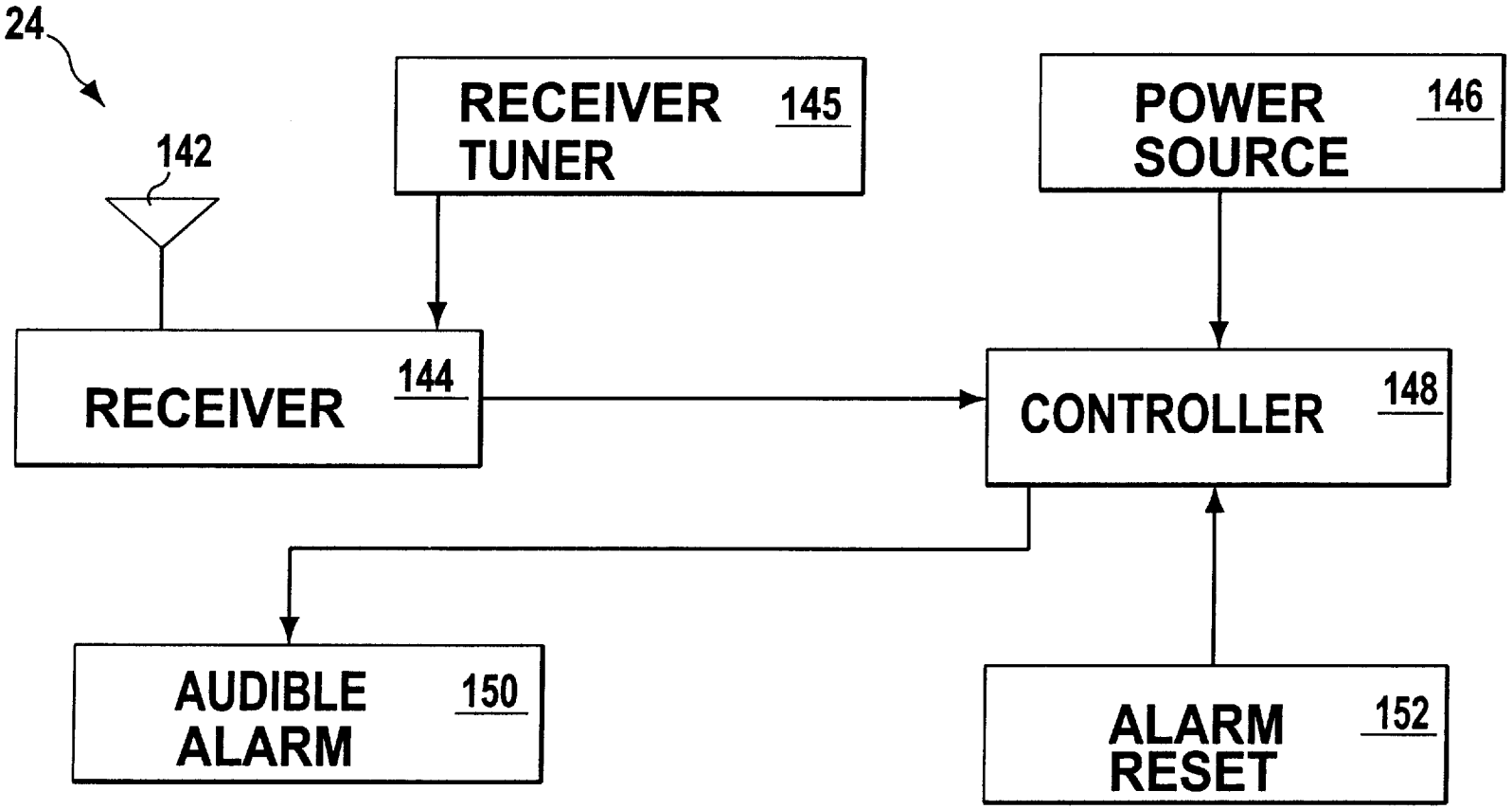
FIG. 8 is a schematic diagram of an outdoor alarm for use in the extra security smoke alarm system of the present invention.

FIG. 8 is a schematic drawing of the outdoor alarm unit 24. The outdoor alarm unit 24 is positioned at an outer periphery of the monitored area 26 for providing an audible indication that an emergency situation exists to persons in the vicinity of the monitored area 26. If the monitored area 26 is a building, the outdoor alarm unit 24 will be positioned on an outer wall of the building. The outdoor alarm unit 24 includes a receiver antenna 142 connected to a receiver 144 for receiving signals indicative of an alarm situation from the central monitoring unit 14. A receiver tuning apparatus 145 is connected to the receiver 144 for tuning the receiving frequency of the receiver 144 to match the transmission frequency of the signals transmitted by the central monitoring unit 14.

A controller 148 is connected to receive power from a power supply 146 and to the receiver 144 for analyzing the signals received from the central monitoring unit 14 to determine if a signal indicating an emergency situation has been received. The power supply 146 may be an internal supply such as a battery or may be an external source such as a conventional electrical outlet. Also connected to the controller 148 is an audible alarm 150 for producing an audible indication that an emergency situation exists and a reset switch 152 for resetting the outdoor alarm unit 24 upon a receipt of a false emergency signal or upon resolution of the emergency situation.

Figure 9:
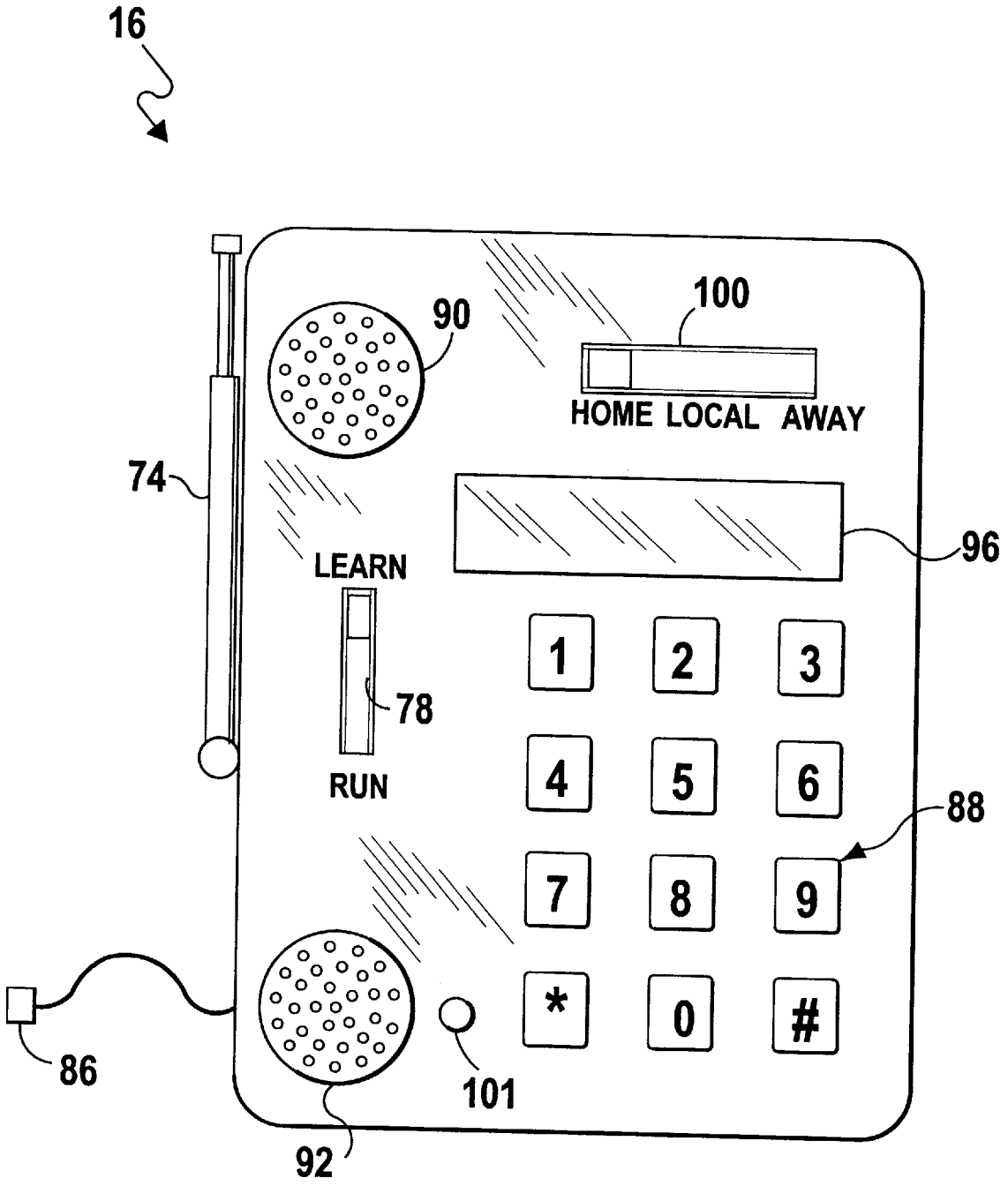
FIG. 9 is a front perspective view of the telephone unit for use with the extra security smoke alarm system of the present invention.

A front face of the telephone unit is illustrated in FIG. 9. As can be clearly seen, the receiver antenna 74 extends from the device for receiving signals from the central monitor unit 14 for analysis by the controller 82 contained therein. The keypad 88 is prominently located on the face for use by a person in manually dialing a telephone number to communicate with a desired party. The telephone connector 86 extends from the unit 16 for connection to a conventional telephone line 17 and thus wired telephone communication. This unit 16 operates in the speakerphone mode at all times and includes a speaker 90 for listening to a party at the other end of the communication and a microphone 92 into which the user will speak. A learn/run switch 78 is provided for programming emergency telephone numbers into the unit 16 and recording emergency messages stating the location of the structure and the nature of the emergency for use in contacting emergency personnel. A display 96 is provided to show the number being dialed and also to display a message indicating the nature of the emergency. The mode switch 100 includes three operating modes, home, local and away. The switch 100 is placed in the home mode when the user or residents are located within the monitored area 26. Upon determining an emergency situation exists, the telephone unit 16 will generate an audible alarm, display a message "awaiting input" and sets a timer for awaiting activation of the reset button 101 located on the face of the unit 16 when operating in this mode. In the away mode the users or residents are outside of the monitored area 26 and upon determining an emergency situation exists, the telephone unit 16 will automatically dial the emergency numbers programmed into the memory and play the programmed recorded message for the emergency personnel. The paging feature will be activated when the switch 100 is in the local mode and thus the residents of the monitored area will be paged upon a determination that an emergency situation has been sensed.

Figure 10:
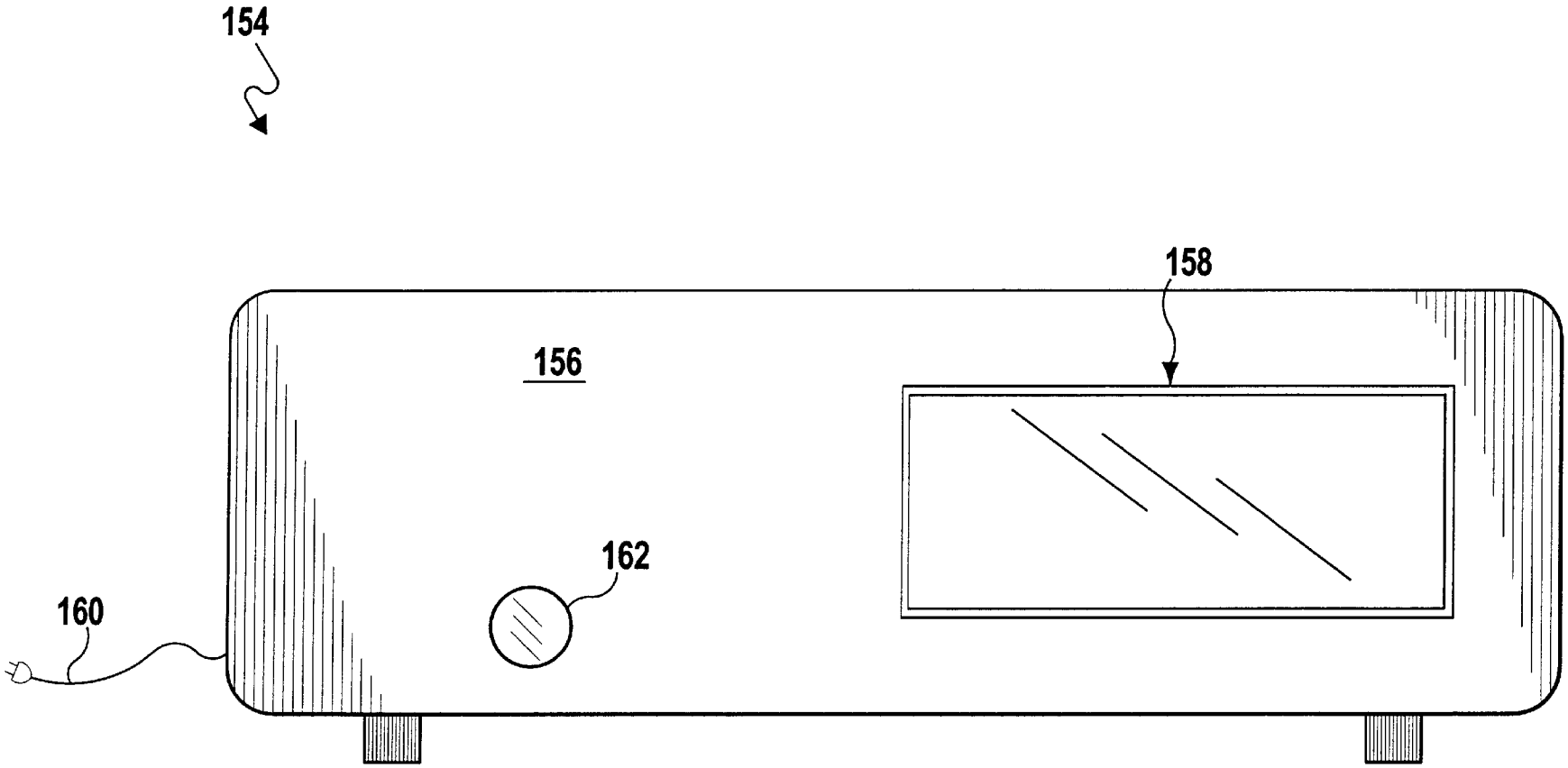
FIG. 10 is a front perspective view of a monitor unit for use with the extra security smoke alarm system of the present invention.

FIG. 10 illustrates a console 154 of the central monitor unit 14. The console 154 is centrally situated within the monitored area 26 so it may be readily viewed by the residents of the area. The monitor console 154 includes a face side 156 having an LED display 158 prominently located for displaying a message indicative of the status of the system 10. A power cord 160 extends from the console 154 for connection with an external electrical source to power the console unit 154. An additional internal power source or backup power source may be located within the console 154. Also located on the face side 156 of the console 154 is the reset button 162 for resetting the central monitor unit 14 and the system 10 upon determining that a false emergency signal has been received or upon resolution of the emergency situation.

Figure 11:
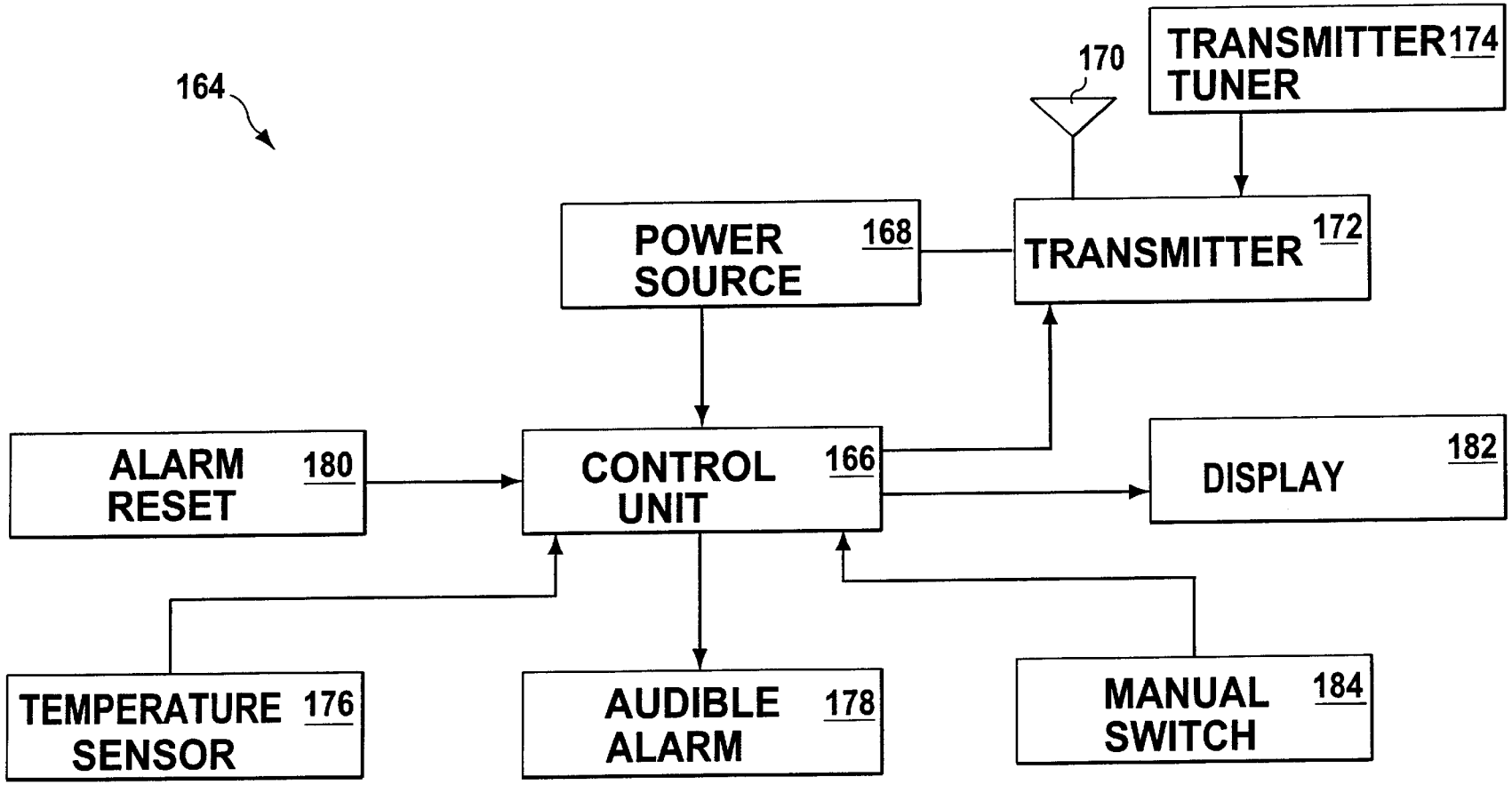
FIG. 11 is a schematic view of a temperature sensor for use with the extra security smoke alarm system of the present invention.

A schematic drawing of a temperature sensor 164 is shown by FIG. 11. Each temperature sensor 164 is positioned about the monitoring area 26 and includes a control unit 166 connected to receive power from a power supply 168 for determining if an emergency situation has been sensed. The power supply 168 may be an internal supply such as a battery or may be an external source such as a conventional electrical outlet. A transmitting antenna 170 is connected to a transmitter 172 also contained within the temperature sensor 164 for transmitting sensor signals to the central monitoring unit 14 indicative of conditions sensed by the temperature sensor 164. A transmitter tuning apparatus 174 is connected to the transmitter 172 for tuning the transmitting frequency of the transmitter 172 to match the receiving frequency of the central monitoring unit 14. Each temperature sensor 164 is able to transmit signals at a plurality of different frequencies. This reduces interference in the transmitted signals and prevents cross talk with other systems monitoring nearby areas. A temperature sensor 176 is connected to the control unit 166 for sensing temperature conditions in the area surrounding the temperature sensor unit 164 and generating a signal indicating the sensed conditions to the control unit 166 for analysis and generation of signals indicative of the sensed conditions. The control unit 166 is connected to the transmitter 172 for sending signals indicative of the sensed conditions to the central monitoring unit 14. An audible alarm 178 such as an amplifier and speaker combination is connected to the control unit 166 for generating an audible alarm upon a determining by the control unit 166 that an emergency situation has been sensed by temperature sensor 176. Also connected to the control unit 166 is an alarm reset button 180 for resetting the alarm monitor 12 after the audible alarm 178 has been triggered and a display 182 providing a visual indication of the conditions sensed by the temperature sensor 176 and the actual temperature in the environment surrounding the sensor unit 164. A manual switch 184 is connected to the control unit 166 for manually turning the temperature sensor unit 164 on and off.

Figure 12:
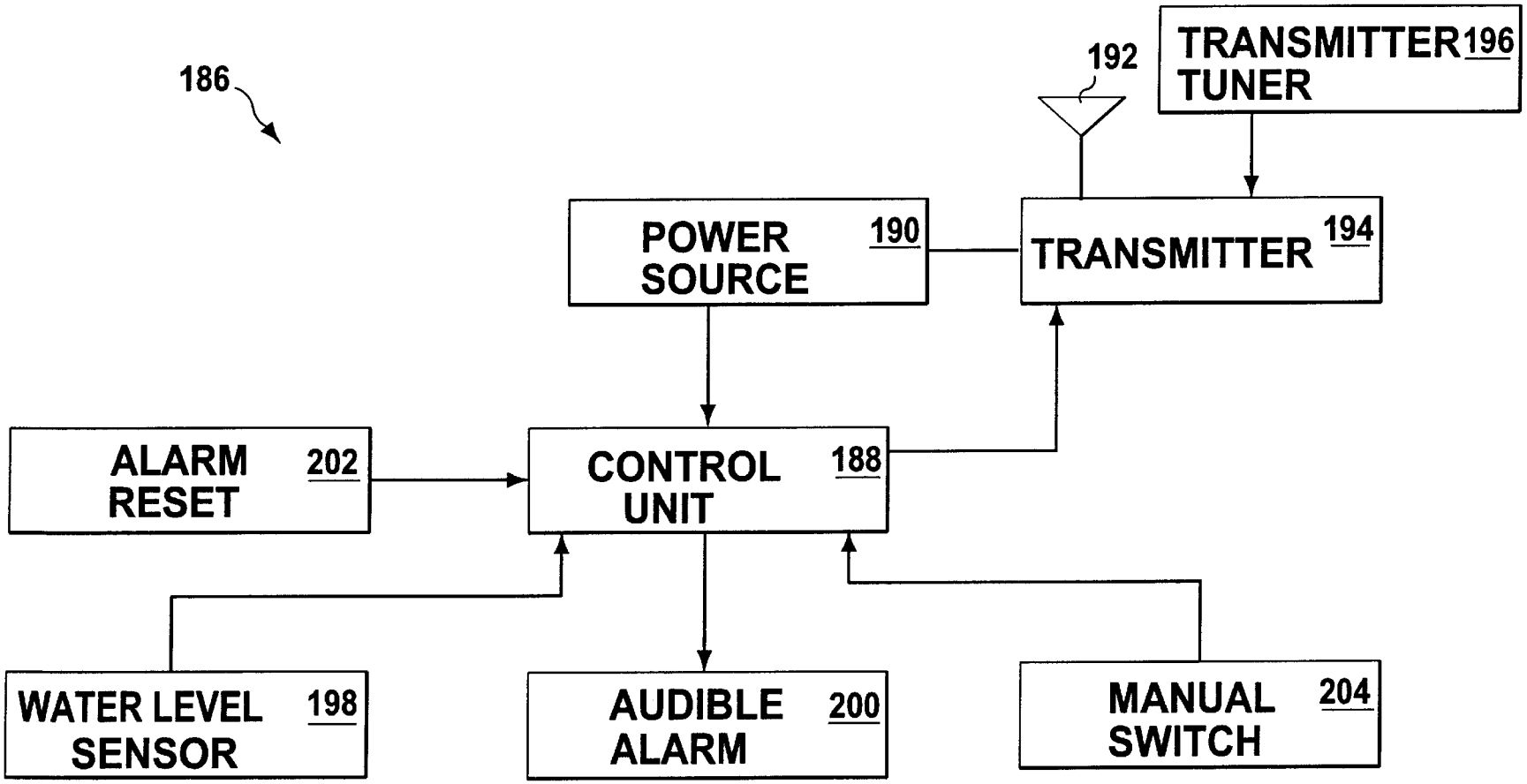
FIG. 12 is a schematic view of a water level sensor for use with the extra security smoke alarm system of the present invention.

A schematic drawing of a water level/flood sensor 186 is illustrated in FIG. 12. Each water level sensor 186 is positioned about the monitoring area 26 and includes a control unit 188 connected to receive power from a power supply 190 for determining if a high water level situation has been sensed. The power supply 190 may be an internal supply such as a battery or may be an external source such as a conventional electrical outlet. A transmitting antenna 192 is connected to a transmitter 194 also contained within the water level sensor 186 for transmitting sensor signals to the central monitoring unit 14 indicative of conditions sensed by the water level sensor 186. A transmitter tuning apparatus 196 is connected to the transmitter 194 for tuning the transmitting frequency of the transmitter 194 to match the receiving frequency of the central monitoring unit 14. Each water level sensor 186 is able to transmit signals at a plurality of different frequencies. This reduces interference in the transmitted signals and prevents cross talk with other systems monitoring nearby areas. A water level sensor 198 is connected to the control unit 188 for sensing water level conditions in the area surrounding the water level sensor unit 186 and generating a signal indicating the sensed conditions to the control unit 188 for analysis and generation of signals indicative of the sensed conditions. The control unit 188 is connected to the transmitter 194 for sending signals indicative of the sensed conditions to the central monitoring unit 14. An audible alarm 200 such as an amplifier and speaker combination is connected to the control unit 188 for generating an audible alarm upon a determining by the control unit 188 that an emergency situation has been sensed by the water level sensor 198. Also connected to the control unit 188 is an alarm reset button 202 for resetting the water level sensor unit 186 after the audible alarm 200 has been triggered and a manual switch 204 is connected to the control unit 188 for manually turning the water level sensor unit 186 on and off.

The operation of the device will now be described with reference to the figures. In operation, the extra security smoke alarm system 10 is installed in the area to be monitored. The central monitor unit 14 is positioned in a central area which is readily visible and accessible to all persons frequenting the monitoring area 26. The alarm monitors 12 are then calibrated to transmit and receive signals at the same frequency so they may readily communicate with one another and strategically positioned throughout the monitoring area 26. As the central control unit 14 scans the entire spectrum of frequencies transmittable by the alarm detectors 12 it is able to receive any signals transmitted by the alarm detectors 12. The transmitting frequency of the central monitoring unit 14 is then calibrated to match the receiving frequency of the alarm units. The telephone unit 16 is then installed and connected to an existing telephone line 17 if wired communication is desired or placed in a convenient location for use if cellular communication is desired. The operation switch 89 is then placed in the desired position for either wired or cellular use. The frequency at which the telephone unit 16 will receive signals from the central monitoring unit 14 is then calibrated to match the receiving frequency of the alarm monitors 12 as each will be receiving emergency signals from the central monitoring unit 14. The learn/run switch 94 is then placed in the learn position and the telephone numbers to be stored in the memory unit 98 for use in contacting the proper emergency personnel in the event of an emergency situation. Once the telephone unit 16 is set up the mode switch is placed in either the home, away or local position depending upon whether the monitored area will be occupied. The telephone unit 16 may be used as would a conventional telephone at any time after it is installed.

The location flasher unit 18 and outdoor alarm unit 24 are installed about a periphery of the monitored area 26 such as on an outer wall of a building being monitored as illustrated in FIG. 1 for alerting persons in the vicinity of the monitored area as to the existence of an emergency situation. The receiver 104 of the location flasher unit 18 and the receiver 144 of the outdoor alarm unit 24 are tuned to the transmission frequency of the central monitoring unit 14 so they may receive emergency signals from the central monitoring unit 14. A plug 'n power flasher 20 is then positioned within the monitored area and connected with a plurality of lamp flashers 22. The transmitting frequency of the plug 'n power flasher 20 is matched with the receiver frequency of the plurality of lamp flashers 22 so the a plurality of lamp flashers 22 may receive signals from and be controlled by the plug 'n power flasher 20 upon the detection of an emergency situation. The receiver of the plug 'n power flasher 20 is matched with the transmitter frequency of the central monitoring unit 14 so the plug 'n power flasher 20 is able to receive signals indicative of an emergency situation therefrom and control the plurality of lamp flashers 22 based on the received signals. The plurality of lamp flashers 22 may be directly connected to the electrical connectors 125 of the plug 'n power flasher 20 receive power and control signals directly therefrom. Alternatively, the plurality of lamp flashers 22 may be connected to another external power source such as an electrical outlet or contain an internal power source and communicate with the plug 'n power flasher 20 through wireless communication. The alternative sensors such as the temperature sensor 164 and the water level sensor 186 may be positioned within the monitored area 26 to monitor specific conditions within the monitored area 26. All components are now turned on and the system 10 is now ready for use.

The system continuously monitors all conditions within the monitored area 26. The alarm monitors 12 are in constant communication with each other and the central monitoring unit 14 transmitting signals indicative of the sensed conditions. When one of the alarm monitors 12 senses an emergency situation upon analysis by the controller therein, an audible alarm 44 is sounded by the alarm monitor 12 sensing the condition and an emergency signal is transmitted to the other alarm monitors 12 and the central monitoring unit 14. Upon receipt and analysis of the received signal the other alarm monitors 12 will produce an audible alarm signal alerting persons throughout the monitored area 26 that an alarm situation exists within the area 26. The central monitoring unit 14 will also produce an audible alarm and display a message indicating which alarm monitor sensed the emergency situation.

Based upon the received emergency signal the central monitoring unit 14 will generate a signal of a frequency specifically designed for the sensed condition to the telephone unit 16. The telephone unit 16 is able to scan the full range of frequencies transmittable by the central monitoring unit 14 and thus receive any signals transmitted by the central monitoring unit 14. Upon analysis of the received signal the telephone unit 16 retrieves the appropriate telephone numbers and messages from the memory and dials the appropriate emergency personnel when in the away mode and generates an audible alarm when in the home mode. If the mode switch is set to the local position, the pager retained by the residents of the monitored area 26 will also be notified of the sensed emergency situation. The location flasher unit 18, outdoor alarm unit 24 and plug 'n power flasher 20 will also receive a signal from the central monitoring unit 14. The location flasher unit 18 will analyze the received signal and generate a visual alarm by flashing a light to be seen by persons in the vicinity of the monitored area 26, the outdoor alarm unit 24 will analyze the received signal and generate an audible alarm to be heard by persons in the vicinity of the monitored area and the plug 'n power flasher 20 will activate the lamp flashers 22 to generate a visual and audible signal for alerting persons within the monitored area 26 as to the emergency situation. Thus persons in all parts of the monitored area, in the vicinity of the monitored area and the appropriate personnel are alerted to the existence of an emergency situation. The alarms will remain activated until a reset button on one of the components of the system is pressed.

When a reset button is pressed the alarm on the component which was pressed will be turned off and a signal will be transmitted to the central monitoring unit 14. The central monitoring unit 14 will then turn its alarm off and transmit a reset signal to the remaining components causing them to turn their alarms off. The telephone unit will also display a resetting message on its display. The reset signal will cause the entire system to shut down for a period of time, preferably 10 minutes, allowing the condition causing the alarm to trigger to be taken care of and extinguished. Upon expiration of the shut down period the system will continue its normal operation of monitoring conditions throughout the monitored area 26.

From the above description it can be seen that the smoke and intruder monitoring security system of the present invention is able to overcome the shortcomings of prior art devices by providing a smoke and intruder monitoring security system which is able to monitor a large area and alert persons in the vicinity of the area and the proper emergency personnel upon sensing an emergency situation and produce a visible alarm both within and outside a structure being monitored upon sensing of an emergency situation. The smoke and intruder monitoring security system includes a telephone unit for phoning the proper emergency personnel and paging the residents of the monitored area alerting them to the existence of an emergency situation and a plurality of sensors for monitoring a plurality of conditions in communication with both each other and a central monitoring unit. The smoke and intruder monitoring security system also includes a plurality of individual sensor units, each unit being able to transmit signals over a plurality of different frequencies. Furthermore, the smoke and intruder monitoring security system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An extra security alarm system for monitoring conditions within a predetermined monitoring area and alerting persons located within the monitoring area, in a vicinity of the monitoring area and appropriate emergency personnel as to existence of an emergency situation, said extra security alarm system including:

a) a plurality of sensor means strategically positioned throughout the monitoring area for sensing conditions within the monitoring area, each of said plurality of sensor means including a sensor for sensing a plurality of conditions, a control unit for analyzing the conditions sensed by said sensor to determine if an alarm situation exists and generating a sensor signal indicative of the sensed conditions, a transmitter for transmitting the sensor signal to other ones of said plurality of sensor means, receiver means for receiving sensor signals from the other ones of said plurality of sensor means, and alarm means for generating an alarm signal upon determining at least one of an alarm condition has been sensed by said sensor and receipt of a sensor signal indicating an alarm condition has been sensed by one of said plurality of sensor means;

b) a central monitoring unit including receiver means for receiving said sensor signals from said plurality of sensor means, control means for analyzing said received signals to determine if an emergency situation exists and generating an emergency signal upon determining an emergency situation exists, and transmitter means for transmitting said emergency signal;

c) means for alerting emergency personnel upon receipt of an emergency signal from said central monitoring unit comprising telephone means for automatically calling appropriate emergency personnel, said telephone means including a receiver to receive emergency signals issued by said central monitoring unit, telephone controller means for analyzing said emergency signals to determine whether a signal has been received which indicates that an emergency situation exists, and a memory unit for storing a plurality of telephone numbers of emergency personnel, said telephone controller means retrieving selected ones of said plurality of telephone numbers upon analysis of said emergency signals for automatically contacting said appropriate emergency personnel; and d) means for alerting persons in a vicinity of the monitoring area upon receipt of an emergency signal from said central monitoring unit comprising flasher means including a receiver to receive a signal from said central monitoring unit, flasher controller means for analyzing any signal received from said central monitoring unit to determine if a signal indicating an emergency situation has been received, and means connected to said flasher controller means to issue an audible alarm for indicating that an emergency situation exists, and means for flashing existing lights to provide a visual indication that an emergency exists.

2. The extra security alarm system as recited in claim 1, wherein said central monitoring unit further includes display means for indicating which of said plurality of sensor means has sensed an alarm condition.

3. The extra security alarm system as recited in claim 1, wherein said plurality of sensor means each include a receiver tuner for receiving signals transmitted over any of a plurality of frequencies.

4. The extra security alarm system as recited in claim 3, wherein each of said receiver tuners are tuned to an identical frequency.

5. The extra security alarm system as recited in claim 4, wherein said plurality of sensor means each include a transmitter tuner for transmitting signals over any of a plurality of frequencies.

6. The extra security alarm system as recited in claim 5, wherein each of said transmitter tuners are tuned to transmit signals at an identical frequency.

7. The extra security alarm system as recited in claim 6, wherein said central monitoring unit is able to transmit signals to said plurality of sensor means at any of said plurality of transmitting frequencies.

8. The extra security alarm system as recited in claim 7, wherein said central monitoring unit is able to scan through a range of frequencies for receiving signals transmitted by said plurality of sensor means at any of said plurality of transmitting frequencies.

9. The extra security alarm system as recited in claim 1, wherein said means for alerting emergency personnel includes a cellular transmitter for contacting emergency personnel thorough cellular telephone networks upon receipt of an emergency signal from said central monitoring unit.

10. The extra security alarm system as recited in claim 1, wherein said plurality of sensor means are each able to sense at least one of smoke, carbon monoxide, propane gas, motion, light, temperature and water level to determine if an emergency situation exists.

11. The extra security alarm system as recited in claim 1, wherein said means for alerting persons includes a flasher positioned at a periphery of the monitoring area for generating a visible signal upon receipt of an emergency signal from said central monitoring unit to alert persons located in a vicinity of the monitoring area as to existence of an emergency situation.

12. The extra security alarm system as recited in claim 1, wherein said central monitoring unit includes a reset button for shutting down said system upon generation of said emergency signal.

13. The extra security alarm system as recited in claim 12, wherein said reset button shuts down said system for a predetermined amount of time.

14. The extra security alarm system as recited in claim 1, wherein each of said plurality of sensor means further includes a reset button for shutting down said system upon generation of said emergency signal.

15. The extra security alarm system as recited in claim 1, wherein said central monitoring unit further includes a reset button for shutting down said system upon generation of said emergency signal.

* * * * *